US005186027A

United States Patent [19]

Tenconi

[11] Patent Number: 5,186,027

[45] Date of Patent: Feb. 16, 1993

[54] CIRCULAR KNITTING MACHINE OF THE TYPE WITH CYLINDER AND DIAL WITH THREAD CLAMPING AND CUTTING DEVICE FOR MANUFACTURING OPEN FABRIC

[75] Inventor: Riccardo Tenconi, Varese, Italy

[73] Assignee: Mec-Mor S.r.l., Induno Olona, Italy

[21] Appl. No.: 756,713

[22] Filed: Sep. 9, 1991

[30] Foreign Application Priority Data

Sep. 14, 1990 [IT] Italy ..... 21471 A/90

[51] Int. Cl.[5] ..... D04B 35/00

[52] U.S. Cl. ..... 66/147; 66/145 R; 66/146

[58] Field of Search ..... 66/145 R, 146, 147

[56] References Cited

U.S. PATENT DOCUMENTS

| | | | |
|---|---|---|---|
| 1,863,720 | 6/1932 | Lawson et al. | 66/145 X |
| 2,201,092 | 5/1940 | Hug | 66/145 R |
| 2,233,738 | 3/1941 | Grill | 66/145 R X |
| 3,016,725 | 1/1962 | Kimrey et al. | 66/145 R |
| 3,188,835 | 6/1965 | Mayer et al. | 66/145 R |
| 3,919,862 | 11/1975 | Wood et al. | 66/145 R X |

FOREIGN PATENT DOCUMENTS

| | | | |
|---|---|---|---|
| 1922726 | 11/1969 | Fed. Rep. of Germany | 66/145 R |
| 2516688 | 11/1975 | Fed. Rep. of Germany | 66/145 R |
| 1128125 | 1/1957 | France | 66/145 R |
| 1265774 | 5/1961 | France | 66/145 R |

*Primary Examiner*—Clifford D. Crowder
*Assistant Examiner*—John J. Calvert
*Attorney, Agent, or Firm*—Guido Modiano; Albert Josif

[57] ABSTRACT

The circular knitting machine, for manufacturing open fabric, has a thread clamping and cutting device arranged inside the needle cylinder and there is a thread engagement element which is controllably movable from the inside of the needle cylinder toward the outside, and vice versa, in the needle cylinder region which faces the dial, so as to engage the threads at the end of their knitting and so as to carry the threads to undergo the action of a presser element, and a cutting element.

13 Claims, 3 Drawing Sheets

CIRCULAR KNITTING MACHINE OF THE TYPE WITH CYLINDER AND DIAL WITH THREAD CLAMPING AND CUTTING DEVICE FOR MANUFACTURING OPEN FABRIC

BACKGROUND OF THE INVENTION

The present invention relates to a circular knitting machine of the type with cylinder and dial with thread clamping and cutting device for manufacturing open fabric.

In the field of circular knitting machines of the type with cylinder and dial, both with fixed cylinder and dial and with rotating cylinder and dial, machines are known which can manufacture an open fabric instead of a tubular fabric.

In such machines, a sector of the needle cylinder and of the dial has no needles, and at said sector there are appropriate devices which clamp and cut the threads knit by the needles.

More particularly, considering a machine with rotating needle cylinder and dial, the threads for forming the knitting are supplied to the needles at one or more feed regions arranged around and above the needle cylinder. After the last needle before the beginning of the needleless sector has engaged the thread at a feed of the machine, said thread, which remains tensioned between the feed by which it has been supplied and said last needle, is clamped and cut by the clamping and cutting device so that the portion of thread which remains between the needle and said device is retained during the formation of a few successive rows in order to avoid broken meshes. The portion of thread which starts from the feed being considered is instead supplied to the needles which pass by said feed after the needleless sector so as to start the formation of a new row of knitting.

The thread clamping and cutting devices are generally applied to the upper face of the dial at the needleless sector and proximate to the needle knitting region, so that the threads to be clamped and cut can be easily engaged by said devices.

However, this arrangement, which is at first thought the simplest, has some disadvantages.

The clamping and retention of the threads in this region of the machine can in fact hinder the unloading of the last loop formed by the needles which are proximate to the needleless sector.

Furthermore, since safety devices are mounted proximate to the needle knitting region in order to detect anomalies in the operation of the machine, it is necessary to provide appropriate devices which deactivate the safety devices when they are, during the operation of the machine, at the clamping and cutting devices in order to avoid useless stoppages of the machine.

Furthermore, when one wishes to vary the width of the fabric by increasing or reducing the width of the sector at which no knitting is formed, besides moving the clamping and cutting devices it is also necessary to correspondingly move the devices required to deactivate the above mentioned safety devices.

Naturally the width of the sector at which no knitting is formed can be varied by including in the knitting, or excluding therefrom, a certain number of needles which border with the needleless sector of the needle cylinder and of the dial.

SUMMARY OF THE INVENTION

The aim of the present invention is to obviate the above disadvantages by providing a circular knitting machine of the type with cylinder and dial for manufacturing open fabric, wherein the thread clamping and cutting device does not create hindrance or difficulty in the placement of the other devices which must be arranged proximate to the needle knitting region.

Within the scope of this aim, an object of the invention is to provide a machine wherein the clamping and cutting device does not hinder the unloading of the loops on the part of the needles which are proximate to said device.

Another object of the invention is to provide a machine wherein the operations for varying the width of the open fabric to be manufactured are simple and rapid to perform.

This aim, these objects and others which will become apparent hereinafter are achieved by a circular knitting machine of the type with cylinder and dial with thread clamping and cutting device for manufacturing open fabric, characterized in that the thread clamping and cutting device is arranged inside the needle cylinder, a thread engagement element being provided and being controllably movable from the inside of the needle cylinder toward the outside and vice versa, in the region of the needle cylinder which faces the dial, for the engagement of the threads at the end of their knitting and for their engagement with said clamping and cutting device.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figures 1, 2, 3:
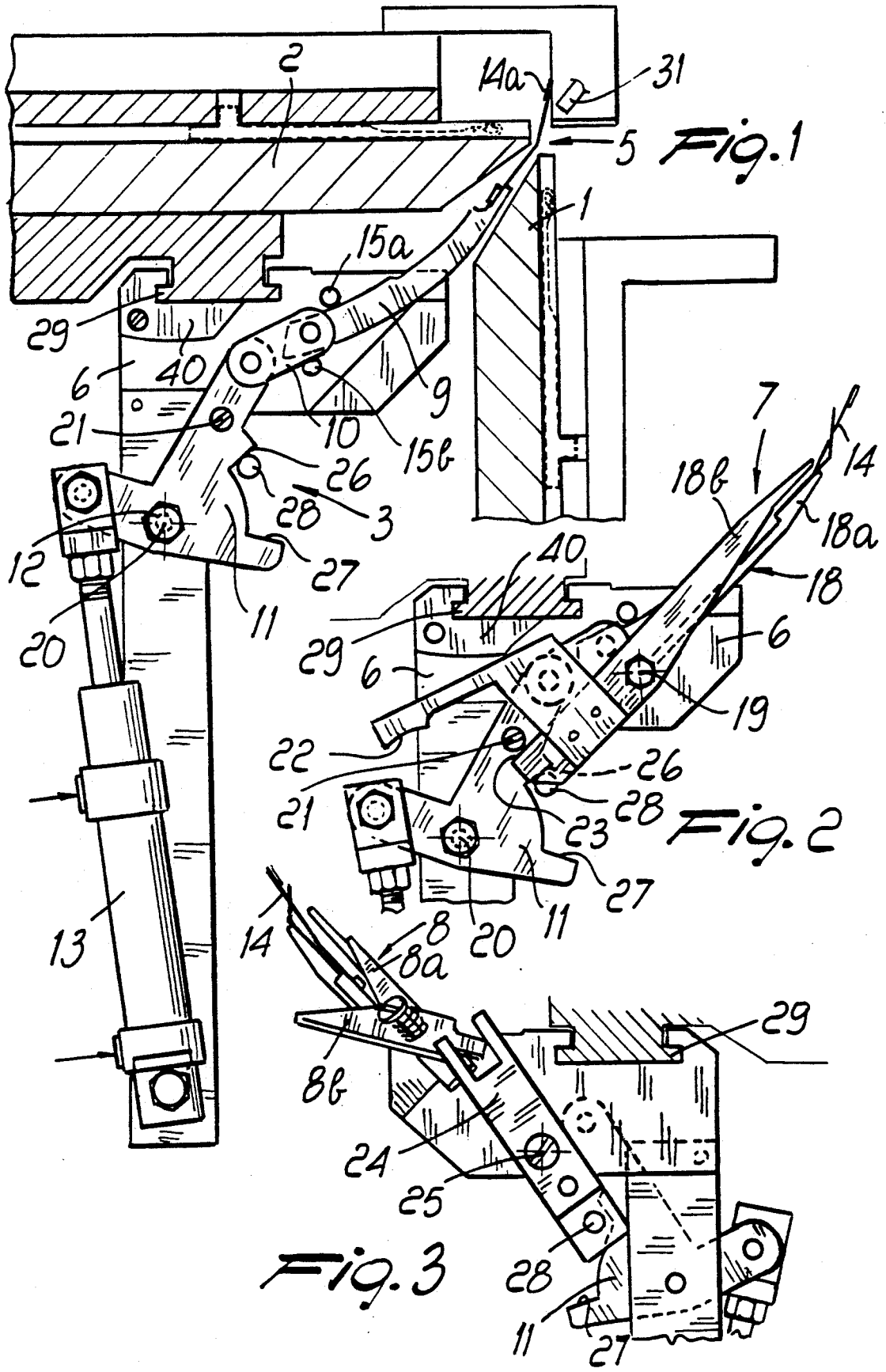
FIG. 1 is a schematic sectional lateral elevation view of a portion of the machine according to the invention with the clamping and cutting device, in which some components have been removed for the sake of clarity.
FIG. 2 is a lateral elevation view of a detail of the camping and cutting device, taken from one side.
FIG. 3 is a lateral elevation view of a detail of the clamping and cutting device, taken from the other side.

With reference to the above figures, the machine according to the invention, which is only partially illustrated for the sake of simplicity, is of the type with a needle cylinder 1 and with a dial 2 which have a needleless sector thereof and with a clamping and cutting device 3 for the thread 4 which is arranged proximate to said sector for the manufacture of open fabric.

According to the invention, the clamping and cutting device 3 is arranged inside the needle cylinder 1 and is provided with a thread engagement element 5; said engagement element 5 is controllably movable from the inside of the needle cylinder toward the outside and vice versa in the region of the needle cylinder 1 which faces the dial 2 so as to engage the threads 4 at the end of their knitting and so as to move them inside the needle cylinder in order to undergo the action of the clamping and cutting device 3. Hence, the thread engagement element 5 is movable, through a space between the cylinder 1 and dial 2, from the inside of the cylinder to the outside thereof in order to engage threads 4 at the needle knitting region of the machine and pull such threads inside the cylinder 1.

More particularly, the clamping and cutting device 3 comprises a block 6 which is fixed to the lower face of the dial in the needleless sector thereof, which as mentioned corresponds to the open region of the fabric to be manufactured. Said block supports, besides the engagement element 5, a presser element 7 and a cutting element 8.

Said engagement element 5 comprises a slider 9 which is pivoted, with one of its ends, to a connecting rod 10 which is in turn pivoted to an end of a main lever 11 which is pivoted, with an intermediate portion, to the block 6.

An actuator 13, constituted by a double-action pneumatic jack in the illustrated embodiment, acts on the main lever 11, which can oscillate about its pivot 12.

A lamina 14 is fixed at the other end of the slider 9, which is orientated toward a region in which the needle cylinder 1 faces the dial 2, and the free end 14*a* of said lamina, which is intended to engage the thread, is conveniently hook-shaped.

The slider 9 can furthermore slide between two pins 15*a* and 15*b* and a raised portion 40 which are fixed to the block 6 and act as sliding guides for the slider, controlling its trajectory.

The arrangement of the presser element 7 and of the cutting element 8 on the block 6 is such that the presser element 7 is closer to the schematically illustrated last needle 30, which knits, i.e. takes the thread, before the needleless sector with respect to the cutting element 8. The slider 9 is arranged between the presser element 7 and the cutting element 8.

The presser element 7 comprises thread retention means which are constituted by a leaf spring 16 which rests against an abutment surface 17 of the block 6 and is elastically flexible so as to allow the passage of the thread, engaged by the engagement element 5, between the spring 16 and the surface 17, and the retention thereof in this position.

The presser element 7 also comprises a clamp-like element 18 which is constituted by an arm 18*a*, which is fixed to the block 6, and by a movable arm 18*b*, which can be actuated so as to clamp the thread retained by the spring 16. Said clamp-like element 18 is spaced from the engagement element 5 in the direction of the last needle which engages the thread proximate to the needleless sector, and the leaf spring 16 is arranged between the clamp-like element 18 and the engagement element 5.

The cutting element 8 is constituted by a scissors-like tool which, like the clamp-like element 18, has an arm 8*a* which is fixed to the block 6 and a movable arm 8*b* which can be controllably actuated in order to cut the thread arranged between the arms 8*a* and 8*b*.

Advantageously, the engagement element 5 is operatively connected to the clamp-like element 18 and to the cutting element 8 so as to obtain the actuation of said elements by means of a single actuator which is constituted, in the illustrated case, by the pneumatic jack 13.

More particularly, the arm 18*b* of the clamp-like element 18 is pivoted, with an intermediate portion, to the block 6 about an axis 19 which is parallel to the pivoting axis 20 of the main lever 11. A first abutment 21 is provided on said main lever 11 and is constituted by a pin which, upon the oscillation of the main lever 11 about the axis 20, engages against a first portion 22 and a second portion 23 of the arm 18*b*, causing its oscillation about the axis 19.

The arm 8*b* of the scissors-like tool 8 is pivoted to the block 6 with an intermediate portion and is connected to the main lever 11 by means of a transmission lever 24. The transmission lever 24 is pivoted, with an intermediate portion, to the block 6 about an axis 25 which is parallel to the axis 20. The profile of the main lever 11 has a second abutment 26 and a third abutment 27 which, upon the oscillation of the main lever 11 about the axis 20, engage against a pivot 28 which is fixed to the transmission lever 24, causing its oscillation and thus the oscillation of the arm 8*b* toward or away from the arm 8*a*.

In practice, the main lever 11 acts as an actuation cam which, by means of the abutments 21, 26 and 27, moves the presser element and the cutting element.

Conveniently, the block 6 is coupled to a guide 29 which is fixed to the lower face of the dial 2 and can be adjusted along said guide 29, which extends along a circumference which is concentric to the axis of the needle cylinder 1 so as to allow the adjustment of its position according to the width of the needleless sector.

It should be noted that, for the purposes of the present invention, the term "needleless sector" describes indifferently a sector of the needle cylinder 1 and of the dial 2 which is actually needleless or a sector provided with needles which are not used, i.e. are excluded from the knitting in progress on the machine during a step of its operation.

The operation of the machine according to the invention during the clamping and cutting of the thread or threads is as follows.

After the last needle 30 arranged before the needleless sector according to the direction of rotation of the needle cylinder with respect to the feeds has taken the thread 4, said thread is tensioned between the needle 30 and the thread guide 31, which is schematically illustrated and has supplied it to the feed being considered.

Figure 4:
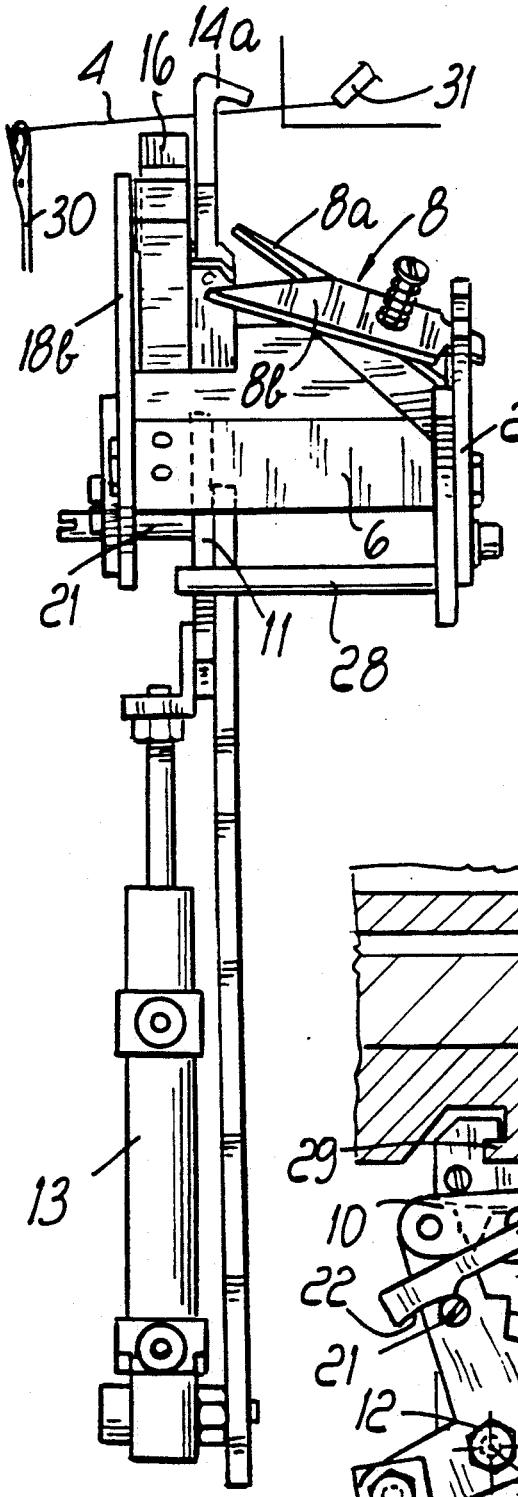
FIG. 4 is a front view of the clamping and cutting device.
Figure 5:
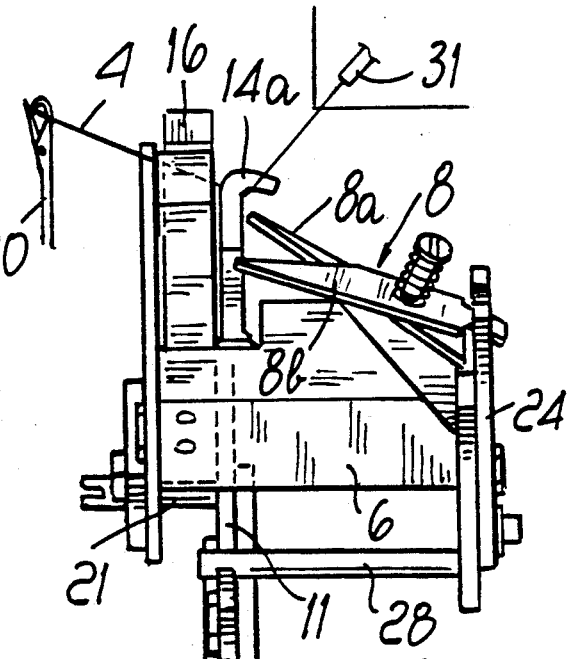
FIG. 5 is a view of a detail of FIG. 4 during the engagement of the thread performed by the engagement element.
Figure 6:
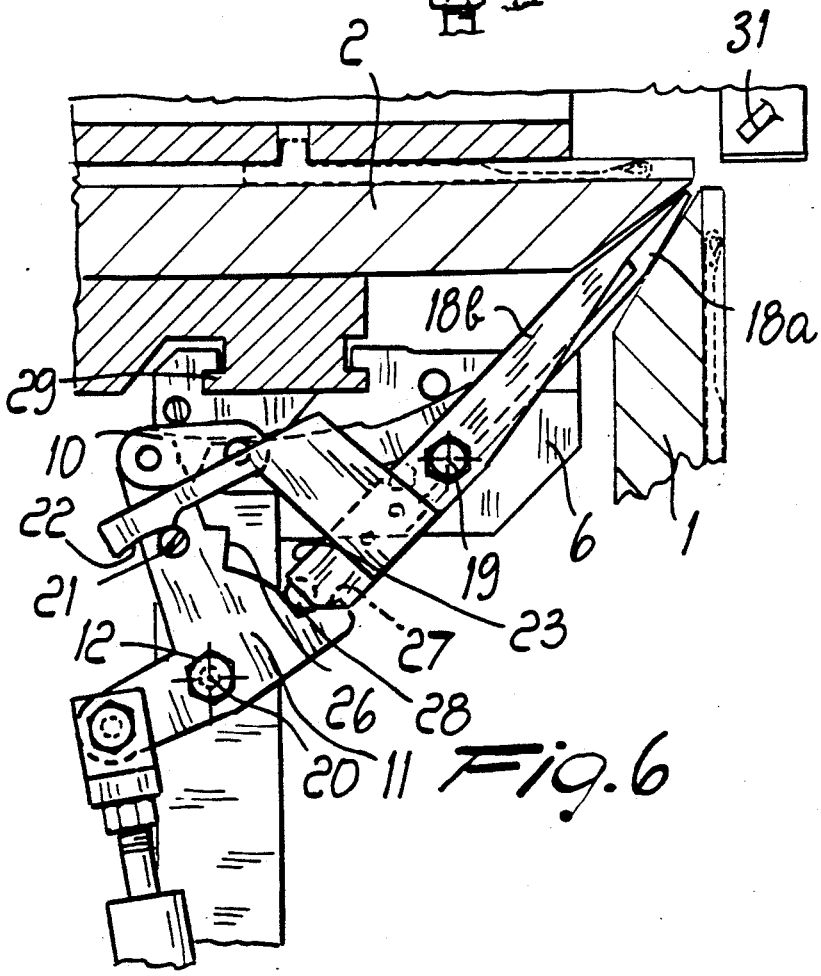
FIG. 6 is a view of the detail of FIG. 2 during the clamping of the thread.
Figures 7, 8, 9:
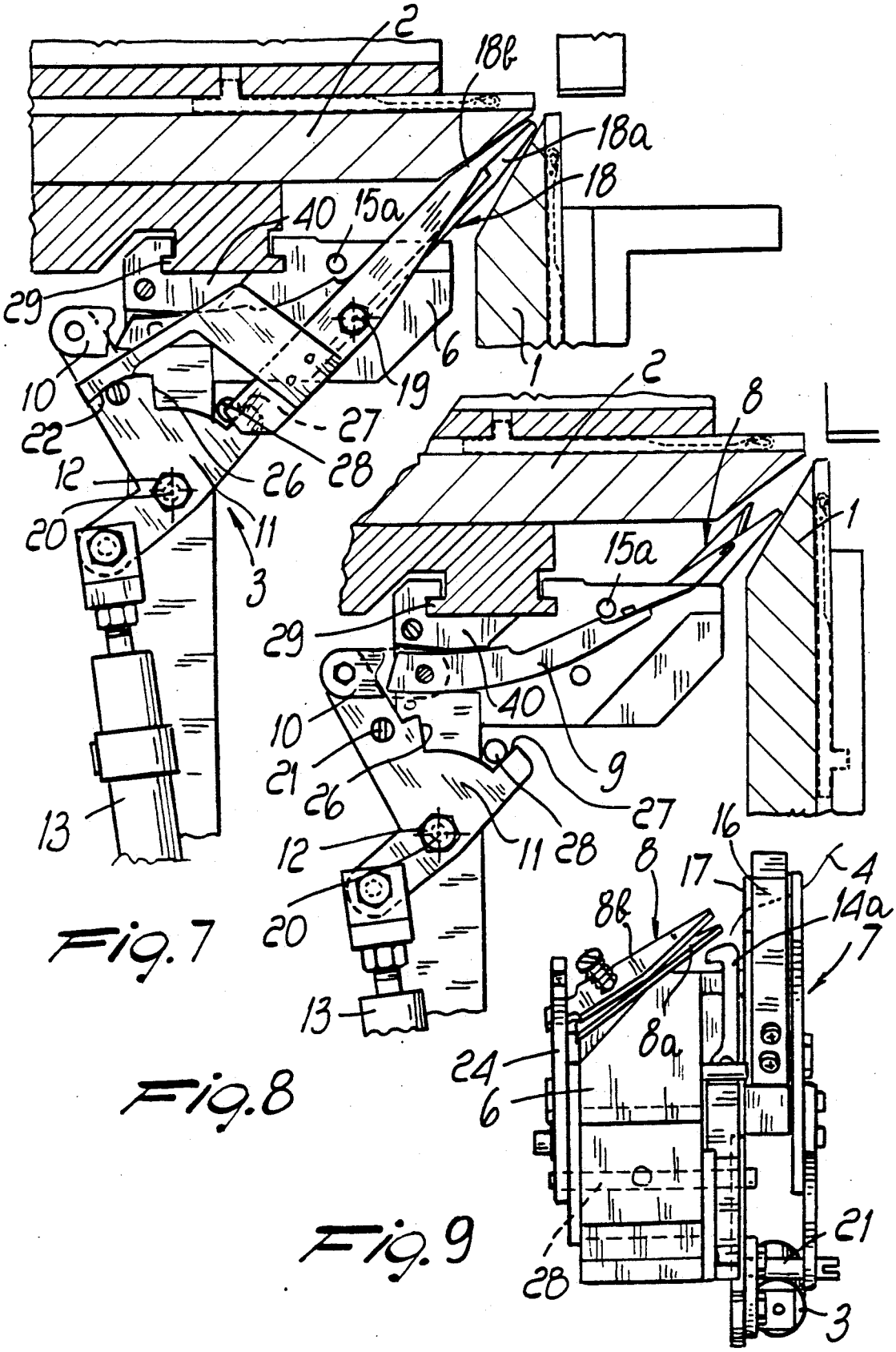
FIG. 7 is a view of the same detail illustrated in FIG. 6 in a further operating step.
FIG. 8 is a lateral elevation view of a detail of the clamping and cutting device, as shown in FIG. 2, in which some components have been removed in order to clearly show the thread cutting step.
FIG. 9 is a top plan view of a detail of the device at the end of the thread clamping and cutting operation.

In this step of operation, the thread engagement element 5 is arranged so that its end 14*a* is extracted from the needle cylinder above the thread 4 (FIGS. 1 and 4). At this point the pneumatic cylinder 13 is actuated and causes the oscillation of the main lever 11, causing the engagement of the thread 4 on the part of the end 14*a* and the pulling of said thread into the needle cylinder (FIG. 5).

The thread 4, engaged by the end 14*a*, is pulled between the elastic lamina 16 and the abutment surface 17 and between the two arms 18*a* and 18*b* of the open clamp-like element 18. As the oscillation of the main lever 11 continues, the clamp-like element 18 closes, strengthening the locking of the thread 4, and the cutting element 8 closes, cutting the thread (FIGS. 6, 7, 8 and 9).

The closure of the clamp-like element 18, by locking the thread, avoids the escape thereof from the leaf spring 16 which could be possible in this step due to the movement of the needle 30 which is unloading the previously formed loop. At this stage, the actuation of the hydraulic jack 13 is reversed, causing the oscillation of the main lever 11 in the opposite direction, with the consequent opening of the cutting element 8 and of the clamp-like element 18 and the protrusion of the end 14*a* of the engagement element 5 (FIG. 1) from the needle cylinder 1.

The end of the cut thread 4, which is engaged with the needle 30, remains retained by the leaf spring 16 in order to prevent broken meshes during the formation of the immediately subsequent stitches, whereas the other end of the thread which arrives from the thread guide 31 is supplied to the first needle which follows the needleless sector.

As knitting continues, after the needle 30 has formed a few stitches, the threads retained by the leaf spring 16 progressively disengage from said spring.

In practice it has been observed that the machine with the clamping and cutting device according to the invention fully achieves the intended aim, since the particular arrangement and execution of said device does not create hindrances in the needle knitting region, considerably simplifying the design and setup of the machine with respect to conventional machines.

Furthermore, by virtue of the fact that the thread clamping and cutting device is arranged at a lower level with respect to the needle knitting region, the unloading of the loops previously formed by the last needles proximate to the needleless sector is facilitated.

The machine thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

I claim:

1. Circular knitting machine comprising a needle cylinder and dial, said needle cylinder and said dial being provided with needles for knitting threads at a needle knitting region of the machine, said needle knitting region of the machine being arranged outside said cylinder and said dial at a region where said cylinder faces said dial, said cylinder defining an inside, a space being defined between said cylinder and said dial which communicates between said inside of said cylinder and said needle knitting region, the circular knitting machine further comprising a thread clamping and cutting device, wherein the thread clamping and cutting device is arranged at said inside of said cylinder, the machine further comprising a thread engagement element also arranged at said inside of said cylinder, said thread engagement element being controllably reciprocally movable through said space and between said inside and said needle knitting region in order to engage threads at said needle knitting region and pull said threads to said inside of said cylinder for engagement thereof with said clamping and cutting device.

2. Machine according to claim 1, wherein said clamping and cutting device comprises a block, said block supporting a thread presser element and a cutting element, said thread engagement element being movable along a trajectory which passes between said presser element and said cutting element in order to tension a thread engaged between an operating region of said presser element and an operating region of said cutting element.

3. Machine according to claim 1, wherein said clamping and cutting device is fixed to a lower face of said plate in a needleless sector of said plate which corresponds to an open region of fabric to be manufactured.

4. Machine according to claim 2, wherein in said clamping and cutting device said presser element is closer to a needle which ends the knitting of an open edge of fabric with respect to said cutting element in order to maintain an engagement of a thread knit by said needle after an intervention of said cutting element.

5. Machine according to claim 2, wherein said presser element comprises a clamp-like element and thread retention means which mutually cooperate to clamp a thread before and after an intervention of said cutting element.

6. Machine according to claim 5, wherein said retention means comprise a leaf spring which presses the thread carried by said engagement element against an abutment surface of said block.

7. Machine according to claim 5, wherein said clamp-like element is controllably activated or deactivated for an engagement or disengagement of the thread engaged by said retention means, said clamp-like element being arranged between said retention means and a needle which ends the knitting of an open edge of the fabric.

8. Machine according to claim 5, wherein said thread engagement element is operatively connected to said clamp-like element and to said cutting element for an actuation of said clamp-like element and of said cutting element, said actuation being correlated to a position of said thread being carried at said inside of said cylinder by said engagement element.

9. Machine according to claim 2, wherein said block supports means for actuating said thread engagement element, said means for actuating comprise a main lever being oscillable with respect to said block and being connected to said thread engagement element, abutments being provided on said main lever, said abutments being engageable, upon an oscillation of said main lever, with said clamp-like element and said cutting element.

10. Machine according to claim 1, wherein said clamping and cutting device is adjustable with respect to said cylinder and to said dial along a circumference which is concentric to an axis of said cylinder.

11. Machine according to claim 1, wherein said thread engagement element comprises a lamina with a hook-shaped free end.

12. Machine according to claim 9, wherein said block supports a pneumatic actuator for actuating said main lever.

13. Machine according to claim 2, wherein said cutting element is constituted by a scissors-like tool.

* * * * *